US005632070A

United States Patent [19]

Wakabayashi

[11] Patent Number: 5,632,070

[45] Date of Patent: May 27, 1997

[54] LOCK SLIDER FOR SLIDE FASTENER

[75] Inventor: Masao Wakabayashi, Toyama-ken, Japan

[73] Assignee: YKK Corporation, Tokyo, Japan

[21] Appl. No.: 686,727

[22] Filed: Jul. 26, 1996

[30] Foreign Application Priority Data

Jul. 31, 1995 [JP] Japan ..... 7-194531

[51] Int. Cl.[6] ..... A44B 19/00

[52] U.S. Cl. ..... 24/419; 24/429

[58] Field of Search ..... 24/419, 429, 437, 24/370, 387, 420, 426, 427

[56] References Cited

U.S. PATENT DOCUMENTS

| | | | |
|---|---|---|---|
| 2,495,539 | 1/1950 | Natzler et al. . | |
| 3,820,203 | 6/1974 | Takamatsu | 24/419 |
| 4,137,609 | 2/1979 | Kedizierski | 24/419 |
| 5,067,209 | 11/1991 | Terada et al. | 24/419 |

FOREIGN PATENT DOCUMENTS 2289917 12/1995 United Kingdom .

*Primary Examiner*—Victor N. Sakran

*Attorney, Agent, or Firm*—Hill, Steadman & Simpson

[57] ABSTRACT

A lock slider for a slide fastener, comprises: a slider body composed of upper and lower wings joined at their front ends, the upper wing having on its lower surface a pair of downwardly projecting side flanges and on its upper surface a pair of upwardly projecting lugs disposed with a width of a pull tab, each of the lugs having a horizontal slot and a pivot insertion hole communicating with the horizontal slot, the upper wing also having at least one locking-pawl insertion hole communicating with one of the horizontal slots; the pull tab having at its base a pair of lateral pivots to be inserted in the respective pivot insertion holes. Further, the pull tab has on one surface at least one locking pawl insertable through the locking-pawl insertion hole when the pull tab is pivotally moved about the base to lie flat on the upper surface of the upper wing. In production, the slider body and the pull tab are simultaneously molded in an assembled form using cores movable from the front, rear, right, left, upper and lower sides.

9 Claims, 7 Drawing Sheets

LOCK SLIDER FOR SLIDE FASTENER

BACKGROUND OF THE INVENTION

1. Field of the Invention

This relates to a lock slider for a slide fastener, and more particularly to a lock slider composed of a pull tab with locking pawls, and a slider body, which are simultaneously molded in an assembled form.

2. Description of the Related Art

As shown in FIG. 10 of the accompanying drawings, Japanese Utility Model Publication No. Sho 51-4809 discloses a conventional lock slider, for a slide fastener, in which a slider body has centrally in its upper surface a rearwardly opening pull-tab-receiving groove 12' in which a pull tab 2' is to be received in such a manner that the upper surface of the pull tab 2' is flush with the upper surface of the slider body 1'. For assembly, a pair of lateral pivots 22' of the pull tab 2' are received in a pull-tab-holding groove 14' disposed at opposite walls of the pull-tab-receiving groove 12' from a rear end to a center position of the slider body 1', whereupon confronting edges 11' at the pull-tab-holding groove 14' is bent downwardly to prevent the pivots 22' from removing from the pull-tab-holding groove 14', in such a manner that the pull tab 2' can be received in the pull-tab-receiving groove 12'.

As shown in FIGS. 11 and 12, U.S. Pat. No. 2,495,539 discloses a lock slider, for a slide fastener, in which a slider body 1" and a pull tab 2" having a locking pawl are simultaneously molded in an assembled form.

In the slider disclosed in this U.S. Patent, an upper wing 3" of the slider body 1" has a cutout 15" extending from one side edge to a central pull-tab-attaching lug 11" so that the pawl 23" of the pull tab 2" can be inserted. The pull-tab-attaching lug 11" has a pair of lateral projections 14" on which a pair of attaching rings 22" of the pull tab 2" are threaded.

According to the lock slider of the first-named publication, the slider body 1' and the pull tab 2' are molded individually, and then they are assembled to complete the slider, which is laborious and time-consuming. Therefore it is impossible to improve the rate of production. Further, if the pull tab 2' is inverted, the pull tab 2' and a locking pawl 23' would project on the slider body 1' to catch and damage a garment or something around.

According to the lock slider of the second-named publication, the cutout of the upper wing 3" is formed by inserting into the mold a side core having a thickness equal to that of the upper wing 3" during molding. Therefore the cutout 15" of the upper wing 3" is devoid of anything, at a flange side, for guiding the fastener elements, namely, for protecting the corners of the fastener elements. In addition, since the front and rear walls of the cutout 15" of the upper wing 3" have acute edges, the upper surfaces of the fastener elements, especially braids of sewing threads, would tend to be damaged due to the movement of the slider.

Further, partly since one end of the cutout 15" is larger in width than the locking pawl 23", and partly since the front end of the slider body 1" is larger in width than the rear end as a shape of the upper wing 3", smooth guiding of the fastener elements could not be achieved. And since the attaching rings 22" of the pull tab 2" are threaded on the respective lateral projections 14" of the pull-tab-attaching lug 11", stable attachment of the pull tab 2" could not be achieved. Still further, since there is only a side flange 6" bridging upper wing portions about the cutout 15", adequate toughness of the slider is difficult to achieve.

SUMMARY OF THE INVENTION

A first object of this invention is to provide a lock slider, for a slide fastener, in which a slider body and a pull tab are simultaneously molded in an assembled form and which is thin, stiff and neat, giving no damage to something around, such as a garment.

A second object of the invention is to provide a lock slider, for a slide fastener, which has a unique form suitable for molding and secures an adequate locking feature.

A third object of the invention is to provide a lock slider, for a slide fastener, which is a thin type and neat in appearance.

A fourth object of the invention is to provide a lock slider, for a slide fastener, in which a pull tab is free to slide on a slider body and can be effectively accommodated in the slider body.

A fifth object of the invention is to provide a lock slider, for a slide fastener, in which a pull tab is kept free from intimate contact with the slider body and is hence easy to handle.

A sixth object of the invention is to provide a lock slider, for a slide fastener, in which is a thin type suitable for assembling.

According to a first aspect of the invention, there is provided a lock slider for a slide fastener, comprising: a slider body composed of upper and lower wings joined at their front ends by a guide post, the upper wing having on its lower surface a pair of downwardly projecting side flanges and on its upper surface a pair of upwardly projecting lugs disposed with a width equal to that of a pull tab, each of the lugs having a horizontal slot and a pivot insertion hole communicating with the horizontal slot, the upper wing also having at least one locking-pawl insertion hole communicating with one of the horizontal slots; the pull tab having at its base a pair of lateral pivots to be inserted in the respective pivot insertion holes, the pull tab also having on one surface at least one locking pawl insertable through the locking-pawl insertion hole when the pull tab is pivotally moved about the base to lie flat on the upper surface of the upper wing; the slider body and the pull tab being simultaneously molded in an assembled form.

According to a second aspect of the invention, the upper surface of the upper wing is divided, by a transverse border line disposed adjacent to and rearwardly of the locking-pawl insertion hole, a front section low in level and a rear section high in level.

According to a third aspect of the invention, each of the pivot insertion holes extends above and perpendicularly to the respective horizontal slot, the respective pivot insertion hole rising from the respective horizontal slot with a height equal to a diameter of the respective pivot insertion hole.

According to a fourth aspect of the invention, the pull tab has on one surface, from which the locking pawl projects, a central projection touchable with the upper surface of the upper wing.

According to a fifth aspect of the invention, the pivots of the pull tab are disposed off the one surface, from which the locking pawl projects, toward the other surface.

According to a sixth aspect of the invention, the upper wing has a pair of locking-pawl insertion holes, while the pull tab has on the one surface a pair of locking pawls insertable through the locking-pawl insertion holes. Further, the upper wing has, for guiding a pair of fastener element rows of the slide fastener, a pair of molded holding portions each extending between the respective flange and the respective locking-pawl insertion hole, and a molded bridging plate extending between the locking-pawl insertion holes.

DETAILED DESCRIPTION OF THE PREFERRED EMBODIMENTS

Preferred embodiments of the lock slider for slide fastener, according to this invention will now be described in detail with reference to the accompanying drawings.

Figure 1:
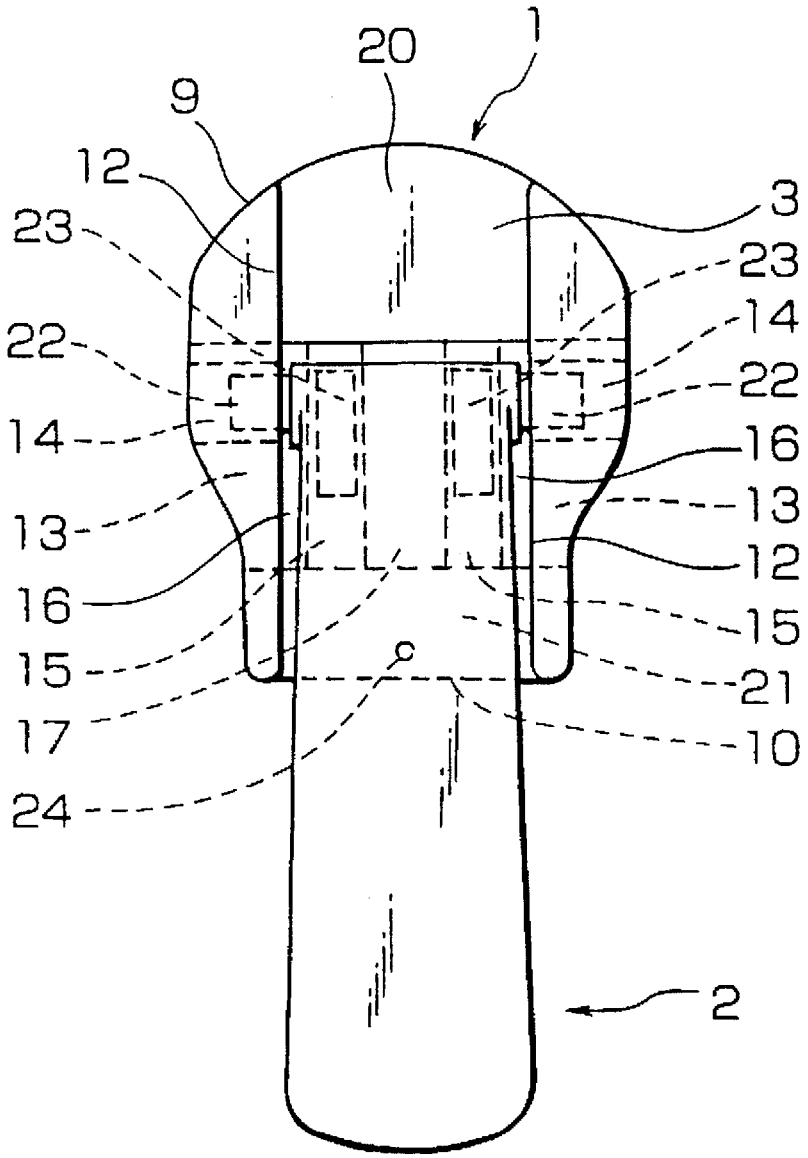
FIG. 1 is a plan view of a double-lock slider, for a slide fastener, according to a first embodiment of this invention.
Figure 2:
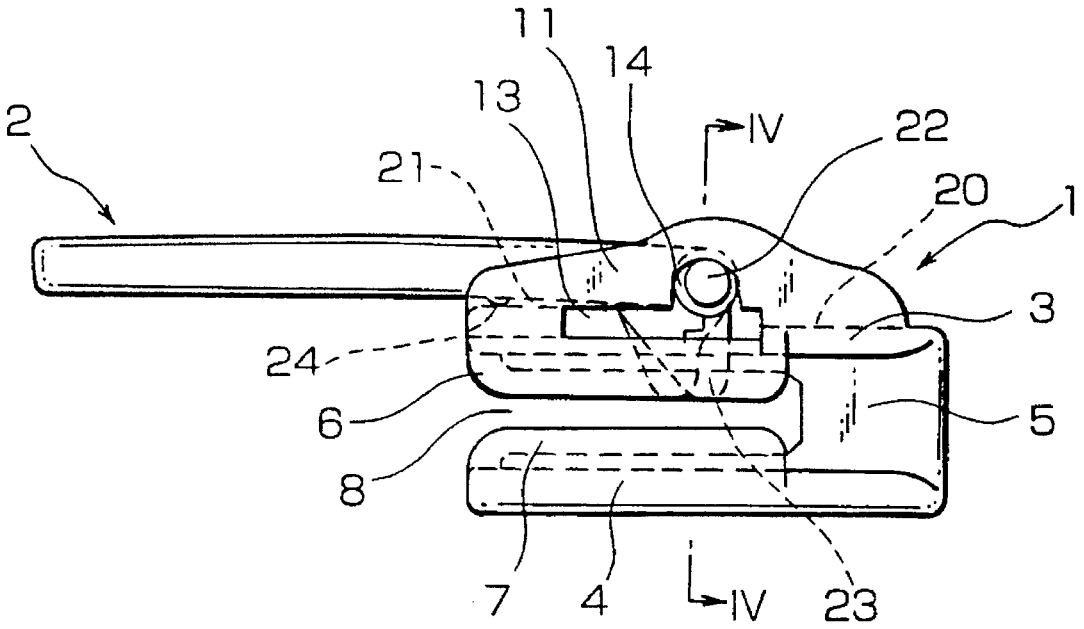
FIG. 2 is a side view of the slider of the first embodiment.
Figure 3:
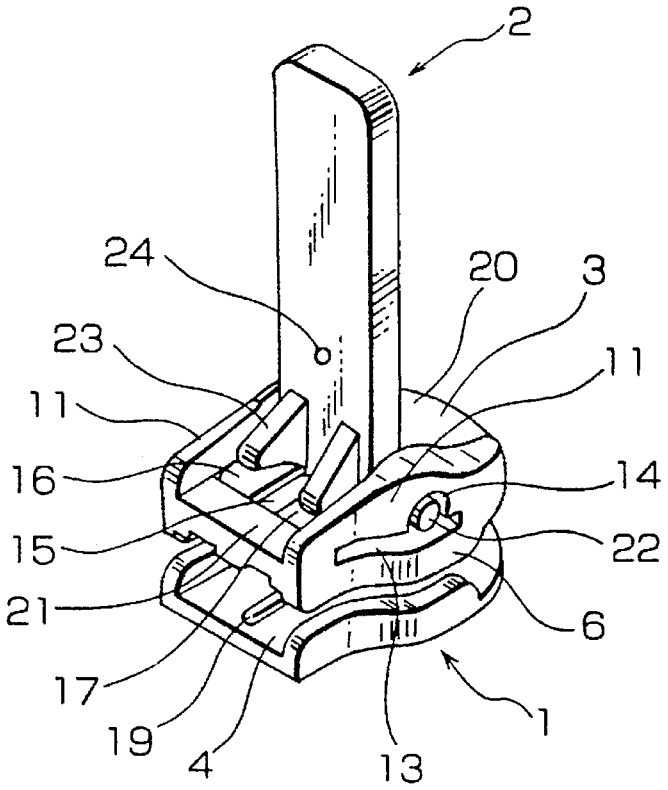
FIG. 3 is a perspective view of the slider of the first embodiment.
Figure 4:
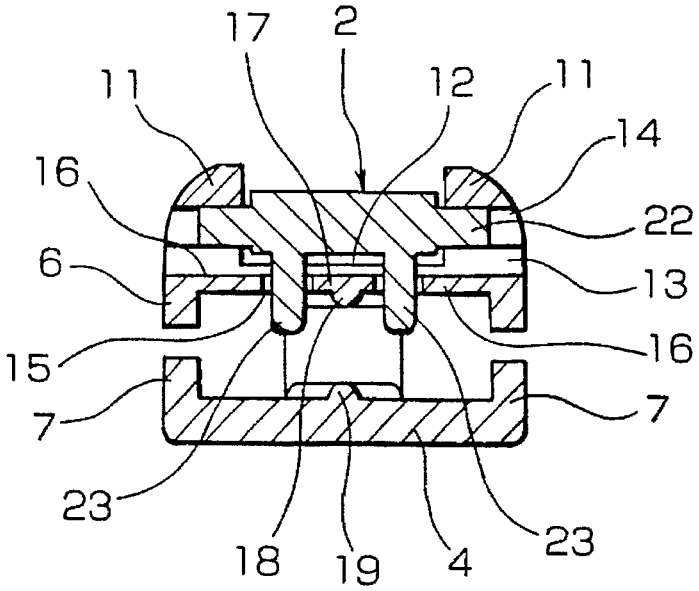
FIG. 4 is a transverse cross-sectional view taken along line VI—VI of FIG. 2.
Figure 5:
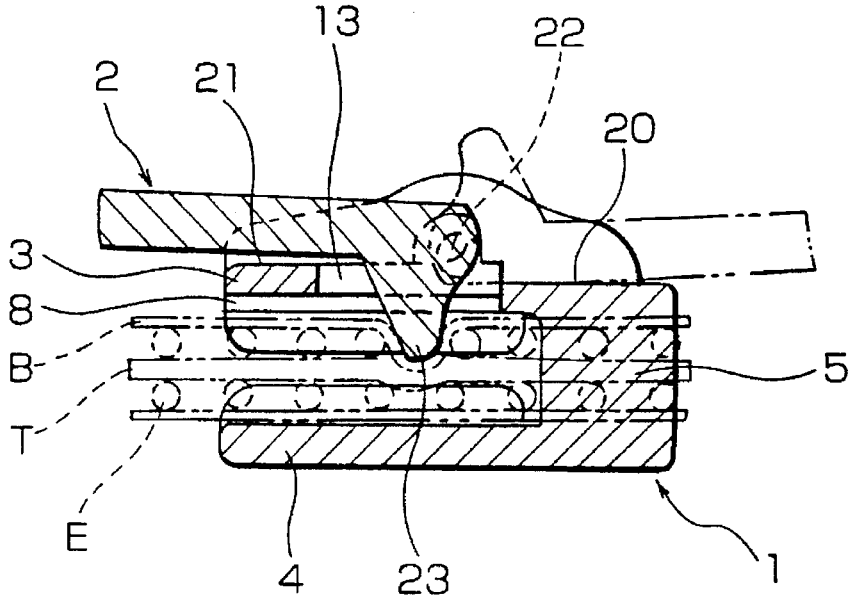
FIG. 5 is a longitudinal cross-sectional view of the slider of the first embodiment, showing the slider in a locked position.
Figure 6:
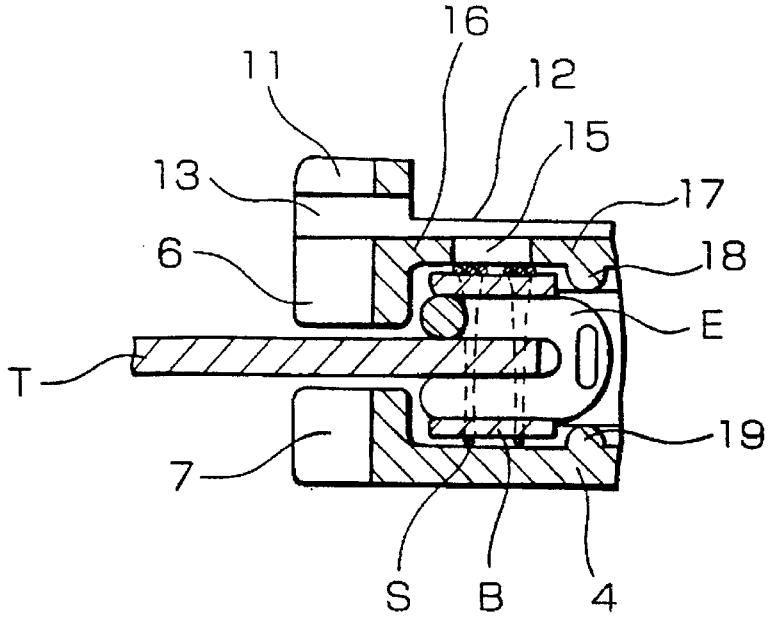
FIG. 6 is a fragmentary transverse cross-sectional view of the slider of the first embodiment, showing the manner in which fastener elements of the slide fastener are guided in a slider body.

As shown in FIGS. 5 and 6, a lock slider of this invention is to be threaded on a fastener chain of the type having a pair of rows of continuous fastener elements E each in the form of a zigzag-shaped mono-filament, which is mounted astride a fastener tape T along its inner longitudinal edge by braids B and sewing threads S, or of the type having a pair of rows of discrete fastener elements, which are mounted astride a pair of fastener tapes along their inner longitudinal edges as by molding or clenching.

Alternatively, the lock slider may be used for a fastener chain of the type having a pair of rows of coiled or zigzag-shaped fastener elements each mounted on one surface of a fastener tape.

The lock slider according to this invention, as shown in FIGS. 1 through 4, generally comprises a slider body 1 and a pull tab 2. The slider body 1 is composed of upper and lower wings 3, 4 joined at their front ends by a guide post 5 and having upper and lower pairs of opposite side flanges 6, 7, each pair along opposite side edges of the respective wing 3, 4, defining a Y-shaped guide channel 8 having a front end mouth 9 at the guide post side and a rear end mouth 10.

The upper wing 3 has on its upper surface at opposite side edges thereof a pair of lugs 11 projecting opposite to and contiguous to the side flanges 6 to define a longitudinal central recess 12 with parallel inner walls. Each lug 11 has a horizontal slot 13 extending between its center to the rear end mouth 10 and having a bottom surface lower than the bottom surface of the central recess 12. Each lug 11 further has a pivot insertion hole 14 extending upwardly from and communicating with the horizontal slot 13 at a position toward its front end, i.e. toward the front end mouth 9, with a height equal to its diameter. Alternatively the pivot insertion hole 14 may be communicated with the horizontal slot 13 by a reduced-width neck portion.

Further, the upper wing 3 has, in the central recess 12 between the lugs 11, a pair of longitudinal locking-pawl insertion holes 15, a pair of flat holding portions 16 disposed the outer sides of the two locking-pawl insertion holes 15, and a central bridging plate 17 disposed between the two locking-pawl insertion holes 15. The holding portions 16 and the bridging plate 17 jointly serve to hold the fastener elements E on their upper side while the fastener elements E are guided in the guide channel 8. The bridging plate 17 has centrally on its lower surface an upper longitudinal ridge 18 with a round peak, and the lower wing 4 has centrally on its upper surface a lower longitudinal ridge 19 with a round peak. The upper and lower longitudinal ridges 18, 19 are disposed in a confronting relationship to guide the braids B attaching the fastener elements E to the fastener tape T.

Further, the bottom surface of the recess 12 of the upper wing 3 is divided, by a transverse border line disposed adjacent to and rearwardly of the locking-pawl insertion holes 14, into a front section 20 low in level and disposed toward the guide post 5, namely, the front end mouth 9, and rear section 21 high in level and disposed toward the rear end mouth 10.

The pull tab 2 is in the form of a rectangular plate slightly enlarged in width at one end remote from its base, having a pair of triangular locking pawls 23 projecting from one surface of the base for insertion through the respective locking-pawl insertion holes 15. The two triangular locking pawls 23 are laterally spaced parallel to each other with their peaks longitudinally staggered. The pull tab 2 has near the locking pawls 23 a central projection 24 to contact with the bottom surface of the recess 12 at the rear section 2. Further, the pull tab 2 has a pair of lateral pivots 22 projecting in opposite directions from opposite sides of the base at positions slightly toward the surface on which the locking pawls 23 stand. The pivots 22 are rotatably received in the respective pivot insertion holes 14 so that the pull tab 2 is pivotable about the pivots 22.

Figure 7:
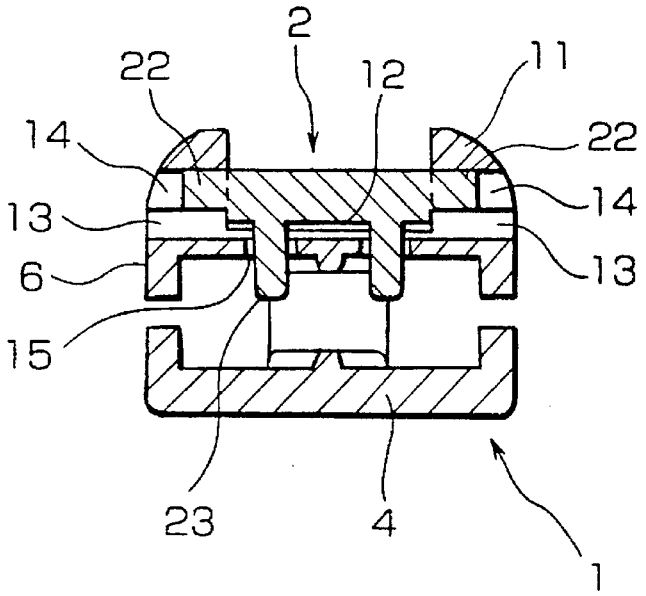
FIG. 7 is a transverse cross-sectional view similar to FIG. 4, but showing a second embodiment.

Alternatively, the pivots 22 of the pull tab 2 may be disposed toward the surface opposite to the surface on which the locking pawls 23 stand, as shown in FIG. 7. In another alternative form, the pivots 22 may project respective centers of opposite side surfaces of the pull tab 2. Further, each pivot 22 of the pull tab 2 may be freely moved between the corresponding pivot insertion hole 14 and the corresponding horizontal slot 13; in this case, the height of the pivot insertion hole 14 must be set to be larger than a height of the horizontal slot 13.

During the sliding movement of the slider, as shown in FIG. 6, the braids B and the sewing threads S covering the fastener elements E can be guided by the bridging plate 17, the holding portions 16 and the flanges 6 without being damaged by the locking pawl holes 15.

In operation, assuming that the slider is to be locked in an arbitrary position on the fastener chain as shown in FIG. 5, the pull tab 2 is placed flat on the upper wing 3 to bring the central projection 24 into contact with the rear section 21 of the bottom surface of the recess 12 and also to bring the locking pawls 23 into the spaces between the fastener elements E. As a result, the slider is prevented from moving along the fastener element rows. For unlocking the slider, the pull tab 2 is brought upright and pulled toward the front end mouth 9 so that the locking pawls 23 are released from the spaced between the fastener elements E to free the slider for movement along the fastener element row. When it is placed against on the upper wing 3, the pull tab 2 is in contact with the lower or front section 20 of the bottom surface of the recess 12 to assume a horizontal posture.

Figure 8:
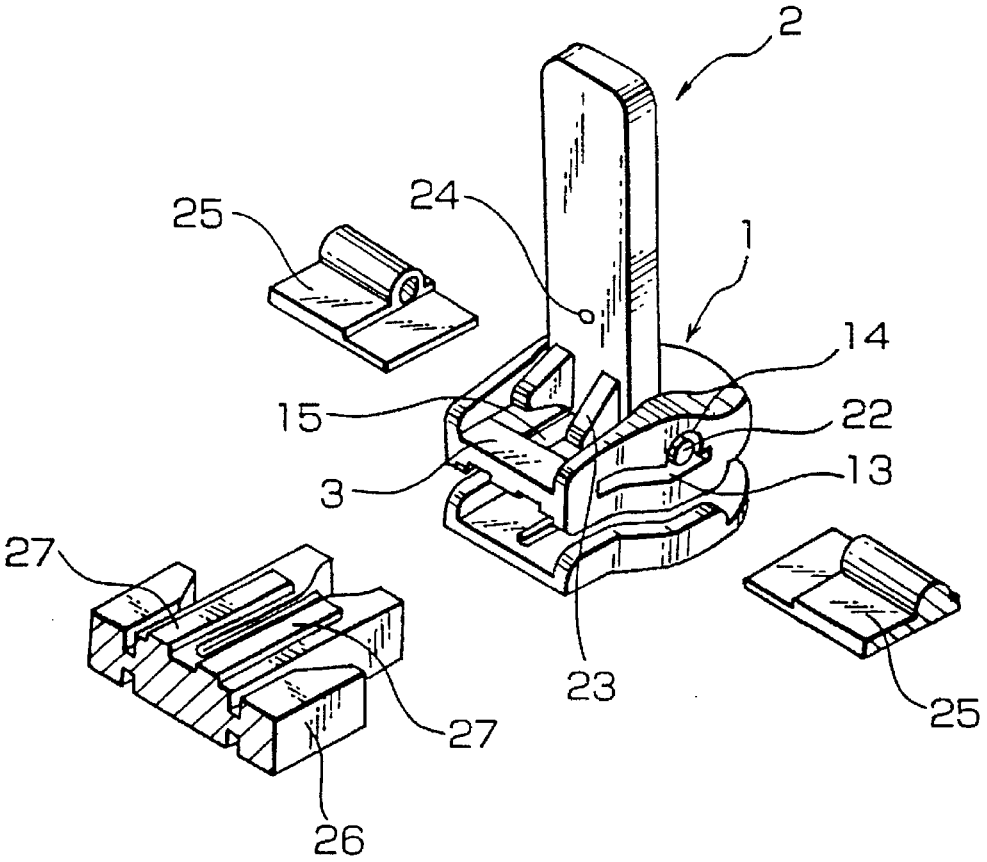
FIG. 8 is a perspective view showing some cores to be inserted into the mold during molding.
Figure 9:
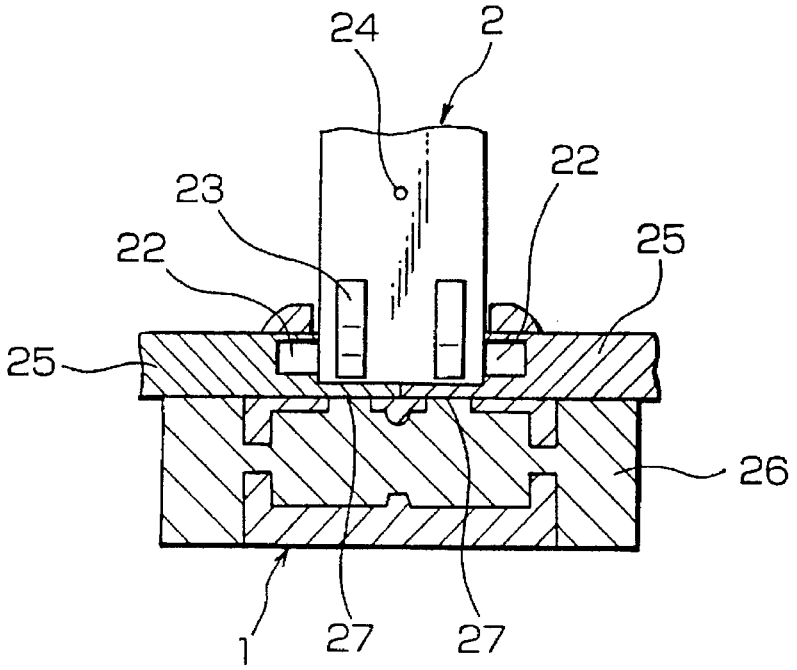
FIG. 9 is a transverse cross-sectional view showing the cores having inserted into the mold during moldings.
Figure 10:
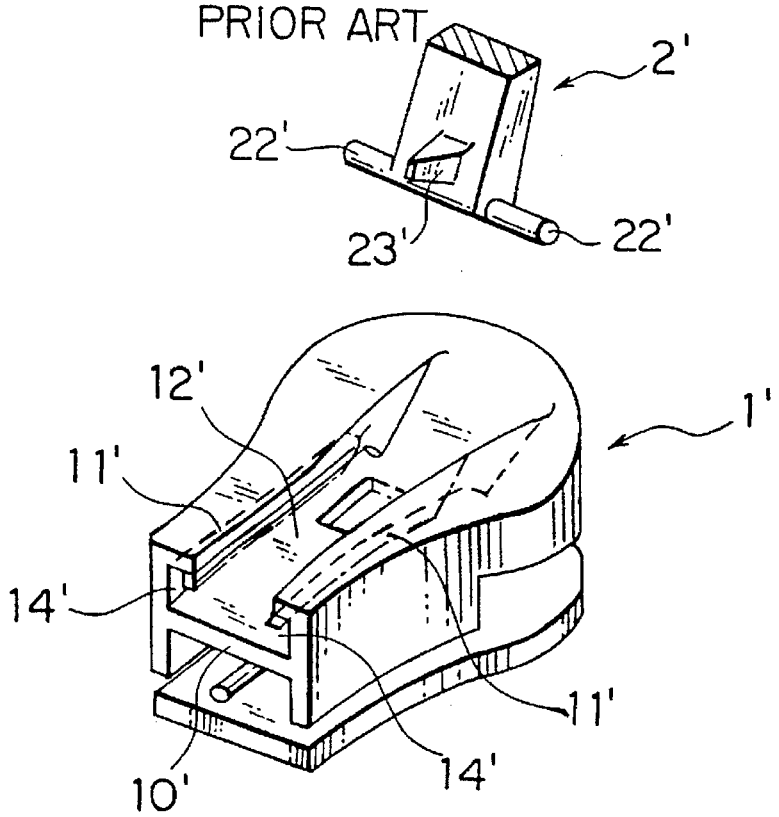
FIG. 10 PRIOR ART
FIG. 10 is an exploded perspective view of a conventional lock slider.
Figure 11:
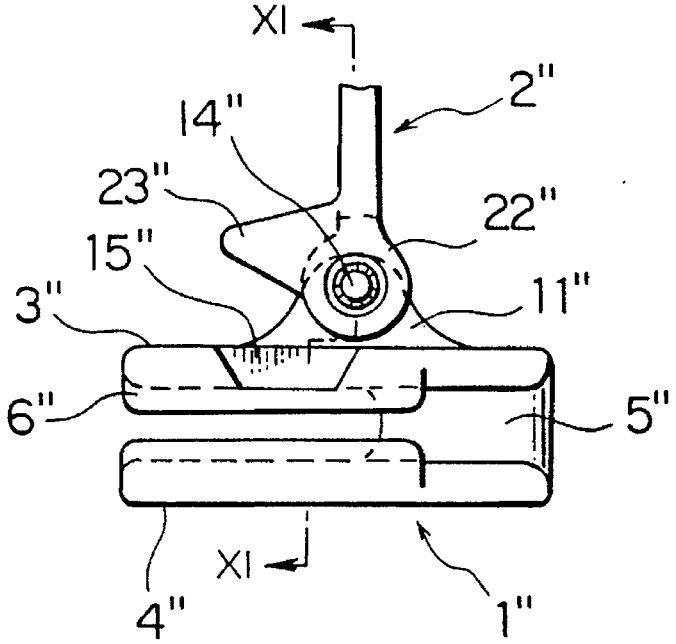
FIG. 11 PRIOR ART
FIG. 11 is a side view of another conventional lock slider.
Figure 12:
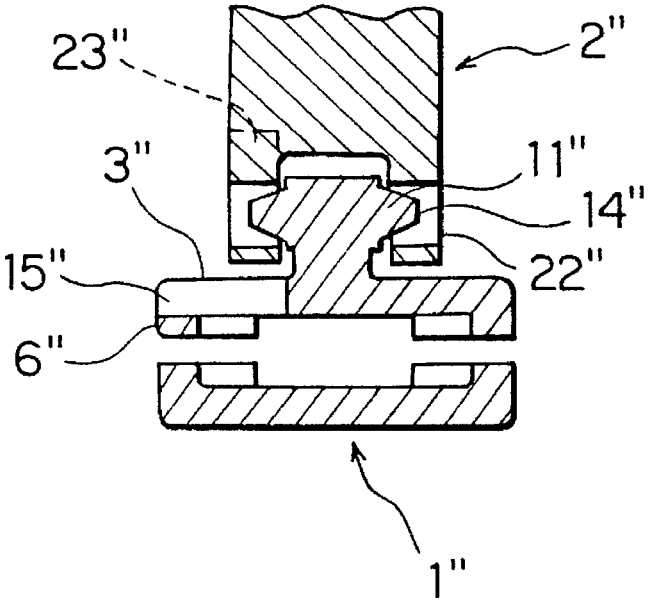
FIG. 12 PRIOR ART
FIG. 12 is a traverse cross-sectional view of the slider taken along line XI—XI of FIG. 11.

In production, as shown in FIGS. 8 and 9, the front, rear, upper and lower cores for molding the slider body 1 and the pull tab 2 of the slider are moved into the mold, while the right and left side cores 25 for molding the pivot insertion holes 14 of the slider body 1, the pivots 22 of the pull tab and the horizontal slots 13 are moved into the mold. At that time, the side cores 25 are inserted through the upper wing 3 and the lugs 11 so as to come into contact with the upper surface of the rear core 26 inserted into the slider body 1 from the rear end mouth 10. The rear core 26 has on its upper surface a pair of projections 27 for molding the locking-pawl insertion holes 15. As the projections 27 are brought in surface-to-surface contact with the opposite side cores 25, the locking-pawl insertion holes 15, the horizontal slots 13 and the pivot insertion holes 14 are molded so as to communicate with one another on each side. The mold is assembled using these cores, whereupon molding material is poured into the mold by injection to mold the slider body 1 and the pull tab 2 simultaneously in an assembled form.

The lock slider of this invention has the following advantages results:

According to the first aspect of the invention, partly since the locking-pawl insertion holes 15 of the upper wing 3 communicate with the corresponding horizontal slots 13 of the lugs 11, the pivot insertion holes 14 being formed above the respective horizontal slots 13 so as to communicate with them respectively, and the locking pawls 23 being aligned with the locking-pawl insertion holes 15, and partly since the slider body 1 and the pull tab 2 are simultaneously molded in an assembled form in such a manner that the pivots 22 of the pull tab 2 are inserted in the respective pivot insertion holes, it is possible to manufacture, in a simple molding process, a lock slider which is a thin type neat in appearance and can secure an excellent locking feature, thus increasing a rate of the productivity.

According to a second aspect of the invention, since the upper wing 3 has, for guiding a pair of fastener element rows E of the slide fastener, a pair of molded holding portions 16 each extending between the respective flanges 6, 7, and the respective locking-pawl insertion holes 6, and a molded bridging plate 17 extending between the lock-pawl insertion holes 15, the slider has a unique form suitable for molding, enables to protect and guide fastener elements E reliably, and secures an adequate locking feature.

According to a third aspect of the invention, since the upper surface of the upper wing 3 is divided, by a transverse border line disposed adjacent to and rearwardly of the locking-pawl insertion holes 15, into a front section 20 low in level and a rear section 21 high in level, it is possible to reduce the slider in thickness and to shorten the locking pawls 23, thus giving no damage to something around.

According to a fourth aspect of the invention, since each of the pivot insertion holes 15 extends perpendicularly to the respective horizontal slot 13 by a uniform width, the pivots 22 of the pull tab 2 can be shifted from the pivot insertion holes 14 to the horizontal slot 13 so that the pull tab 2 can remain a horizontal posture when the slider is locked, giving no damage to something around.

According to a fifth aspect of the invention, since the pull tab 2 has on the one surface, from which the locking pawls 23 project, a central projection 24 touchable with the upper surface of the upper wing 3, it is possible to keep the pull tab 2 from intimate contact with the slider body 1, facilitating handling the pull tab 2.

According to a sixth aspect of the invention, since the pivots 22 of the pull tab 2 are disposed off the one surface thereof, from which the locking pawls 23 project, toward the other surface, it is possible to accommodate the pull tab 2 in a low position as retracted in the slider body 1, making the slider smaller in thickness and neat in appearance.

What is claimed is:

1. A lock slider for a slide fastener, comprising:

(a) a slider body composed of upper and lower wings joined at their front ends by a guide post, said upper wing having on its lower surface a pair of downwardly projecting side flanges and on its upper surface a pair of upwardly projecting lugs disposed with a width of a pull tab, each of the lugs having a horizontal slot and a pivot insertion hole communicating with said horizontal slot, said upper wing also having at least one locking-pawl insertion hole communicating with one of said horizontal slots;

(b) said tab having at its base a pair of lateral pivots to be inserted in the respective pivot insertion holes, said pull tab also having on one surface at least one locking pawl insertable through said locking-pawl insertion hole when said pull tab is pivotally moved about said base to lie flat on the upper surface of the upper wing; and (c) said slider body and said pull tab being simultaneously molded in an assembled form.

2. A lock slider according to claim 1, wherein said upper surface of said upper wing is divided, by a transverse border line disposed adjacent to and rearwardly of said locking-pawl insertion hole, into a front section low in level and a rear section high in level.

3. A lock slider according to claim 2, wherein said pull tab has on said one surface, from which said locking pawl projects, a central projection touchable with said upper surface of said upper wing.

4. A lock slider according to claim 2, wherein said pivots of said pull tab are disposed off said one surface, from which said locking pawl projects, toward the other surface.

5. A lock slider according to claim 1, wherein each of said pivot insertion holes extends above and perpendicularly to the respective horizontal slot, said pivot insertion hole rising from said horizontal slot with a height equal to a diameter of said pivot insertion hole.

6. A lock slider according to claim 5, wherein said pivots of said pull tab are disposed off said one surface, from which said locking pawl projects, toward the other surface.

7. A lock slider according to claim 1, wherein said pull tab has on said one surface, from which said locking pawl projects, a central projection touchable with said upper surface of said upper wing.

8. A lock slider according to claim 1, wherein said pivots of said pull tab are disposed off said one surface, from which said locking pawl projects, toward the other surface.

9. A lock slider according to claim 1, wherein said upper wing has a pair of locking-pawl insertion holes, and said pull tab has on said one surface a pair of locking pawls insertable through said locking-pawl insertion holes, and wherein said upper wing has, for guiding a pair of fastener element rows of the slide fastener, a pair of molded holding portions each extending between the respective flange and the respective locking-pawl insertion hole, and a molded bridging plate extending between said locking-pawl insertion holes.

* * * * *